US006058640A

United States Patent [19]

Young

[11] Patent Number: 6,058,640

[45] Date of Patent: May 9, 2000

[54] TRANSPARENCY DISPLAY APPARATUS

[76] Inventor: Steven R. Young, 7667 Chalkstone Dr., Dallas, Tex. 75248

[21] Appl. No.: 09/041,265

[22] Filed: Mar. 12, 1998

[51] Int. Cl.[7] ..... G09F 19/00; A47G 1/06

[52] U.S. Cl. ..... 40/709; 40/445; 40/765

[58] Field of Search ..... 40/490, 491, 709, 40/765, 766, 775, 445, 363, 365, 366

[56] References Cited

U.S. PATENT DOCUMENTS

| | | | |
|---|---|---|---|
| 370,186 | 9/1887 | Fountain | 40/654 |
| 1,032,024 | 7/1912 | Rawlings | 40/427 |
| 1,603,592 | 10/1926 | Glasner | 40/654 X |
| 2,795,067 | 6/1957 | Walker | 40/365 X |
| 3,079,959 | 3/1963 | Johnston | 40/365 X |
| 3,094,781 | 6/1963 | Vangor | 40/363 X |
| 3,122,859 | 3/1964 | La Reaux, Jr. | 40/363 X |
| 3,409,347 | 11/1968 | Vogel | 40/654 X |
| 3,822,938 | 7/1974 | Hirsch | 40/367 X |
| 4,027,884 | 6/1977 | Oakley | 273/148 R |
| 4,117,615 | 10/1978 | Gomolak | 40/445 X |
| 4,697,364 | 10/1987 | Dean | 40/445 |
| 5,609,253 | 3/1997 | Goade, Sr. | 206/460 |

*Primary Examiner*—Anthony Knight
*Assistant Examiner*—Marcus Dolce
*Attorney, Agent, or Firm*—Jones, Day, Reavis Pogue

[57] ABSTRACT

A transparency display device having at least front and back panels with superimposed windows therein and a transparency covering said windows with a visual image thereon and a slidable panel interposed between the front and back panels for providing a backing for said transparency visual image in a first position to create a first scene and for removing said backing from said transparency visual image in a second position to create a second scene discernibly different than said first scene.

8 Claims, 5 Drawing Sheets

TRANSPARENCY DISPLAY APPARATUS

BACKGROUND OF THE INVENTION

1. Field of the Invention

The present invention relates in general to display packages and more particularly, but not by way of limitation, to an improved display device that has a transparency with a visual image thereon forming a first scene that can be combined with other visual images associated with the display device to form two or more visual scenes to a viewer.

2. Description of Related Art Including Information Disclosed Under 37 CFR 1.97 and 1.98

In commonly assigned copending patent application Ser. No. 08/986,444, filed Dec. 8, 1997, and entitled "Data Card Display Package and Method for Displaying a Data Card", there is disclosed an improved data card package for advertising a data card having coded data disposed thereon. Such packages can be used to sell data cards such as prepaid calling cards for long distance telephone calls or other type cards that are popular with consumers.

One type of card that is specially popular with a segment of the population is a trading card that could have a picture of a well-recognized sports figure or other celebrity and having information on the card relating to that person. Such cards also relate to places or events such as the Grand Canyon, planets in space, and the like.

It would be desirable to provide a data card that utilizes transparencies with at least one visual image thereon that can be viewed in conjunction with a background that may be plain or include other transparencies.

SUMMARY OF THE INVENTION

The present invention relates to a transparency display device in which one or more visual images or pictures can be visible to a viewer. For instance, a transparency could have an athletic figure or prominent personality on a transparency held in a frame. A slidable panel can be placed under the transparency and movable from a first position under the transparency to a second position removed from under the transparency. This would allow the transparency to be visible to light through the package and present a first view of the visible image that is on the transparency. When the slidable panel is moved to its first position under the transparency, then it provides a backing for the transparency which may be a color backing or may have a visual image thereon to provide a different scene when associated with the first visual image. The sliding panel may have printed materials or indicia on the back thereof to describe or otherwise be related to the transparency visual image. As an example, the transparency could have a famous football player as the visual image and on the backside of the slidable panel may be statistics regarding the player. When the slidable panel is moved from its first position under the transparency to its second position removed from under the transparency, the transparency can then be either viewed when held up to light or with the use of a projector.

Other versions of the device provide two transparencies with different visual images thereon separated from each other by spacers and having a slidable panel either between the two transparencies or under both of the transparencies. The slidable panel may have a third visual image on it such that when it is in its first position under both of the transparencies it creates a scene having three different views, the first transparency, the second transparency, and the slidable panel. If the slidable panel is between the two transparencies, then the panel itself provides a backing to create a second scene with the first transparency and when it is removed from under the first transparency, then the first and second transparencies together provide a third scene.

In another version of the invention, a package has an opening or window in the front panel covered by a first transparency with a visual image of some type thereon and the back panel is solid and may have indicia thereon relating to the visual image on the transparency. A slidable panel is interposed between the transparency and the back panel and has a second transparency in a portion of it that is not superimposed with the first transparency when the sliding panel is in its first position. Thus, in its first position the sliding panel has a solid first portion under the first transparency and, when the panel is moved to its second position, the second transparency on the sliding panel is exposed thus showing the first and second transparencies. If desired, there can be a window in the second or back panel that is superimposed with the transparency in the first panel so that, when the sliding panel is moved to its second position, the transparency can be viewed by holding it up to a light or a projector. Thus, in this case, for instance, the transparency could have the earth and any other visual image on a transparency relating to it and, when the sliding panel is moved out, the transparency there may have the picture of an astronaut who was the first to orbit the earth.

In still another version, a larger panel may be provided having multiple windows with a transparency in each of the multiple windows with each transparency having a different visual image. A movable panel may be associated with each transparency either above it or below it. That movable panel may also have a visual image on it such that if it is above the transparency and is moved inwardly to its first position, the visual image on the transparency is visible through the window. In its second position, when it is moved out from under the transparency, then both the transparency visual image and the visual image on the movable panel become visible. The value of this version is that multiple transparencies horizontally spaced apart can be placed in one frame.

Of course, if desired, a package having a solid front cover and a solid back cover, with indicia thereon regarding a certain subject, may be formed with a slidable panel between the front and back covers. The slidable panel may have a transparency with a visual image thereon formed in one portion thereof that is exposed when it is moved out from between the front and back panels. The indicia on the front and back panels may relate to the transparency visual image.

In another embodiment, the package may include a front window, a transparency with a first visual image thereon covering the window, a slidable panel having a second visual image on it for movement underneath and away from the transparency and a bottom or back panel having a third visual image thereon so that as many as three scenes may be combined in one. Thus, when the slidable panel is in its first position under the transparency, then the visual image on the transparency is superimposed over the visual image on the slidable panel. When the slidable panel is moved outwardly from under the transparency, then the third visual image on the back panel is in superimposed relationship with the visual image on the transparency causing a different scene. Again, of course, printed indicia may be on the back side of the package that relates to details of the pictures.

Thus, it is an object of the present invention to provide a transparency display device.

It is another object of the present invention to provide a transparency display device that has a visual image on the transparency that can be combined with one or more other visual images to provide unique scenes for viewing.

It is yet another object of the present invention to provide a transparency display device having a transparency with a visual image thereon of a person, place, or thing and combining one or more additional visual images to create various scenes and having indicia thereon describing or relating to the visual scenes and the transparency visual image.

It is still another object of the present invention to provide a transparency display device that can be used as a trading card featuring athletes and the like.

Thus, the present invention relates to a transparency display device comprising front and back frames each having a window therein in superimposed relationship with each other, a first transparency having a first visual image thereon and covering the window in the front frame, and a first panel having a front and a back and being slidably interposed between the front and back frames for movement between a first position to enable viewing the transparency visual image with a front portion of the first panel serving as a backing for the transparency to create a first scene and a second position to enable viewing the transparency visual image alone as a second scene having a discernibly different visual effect than the first scene.

BRIEF DESCRIPTION OF THE DRAWINGS

These and other features of the present invention will be more fully disclosed when taken in conjunction with the following Detailed Description of the Preferred Embodiments in which like numerals represent like elements and in which.

DETAILED DESCRIPTION OF THE PREFERRED EMBODIMENTS

"Transparency" as used herein means being capable of transmitting light so that objects or images can be seen as if there were no intervening material. The transparent material can be made of plastics such as mylar, acetate, or the like material so long as it can transmit light therethrough. The visual images thereon can be photographed or printed or otherwise placed thereon.

Figure 1:
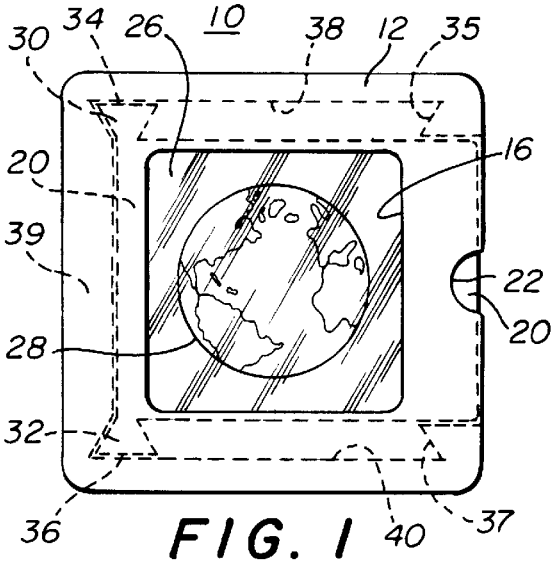
FIG. 1 is a front view of a first embodiment of the transparency display device of the present invention.
Figure 2:
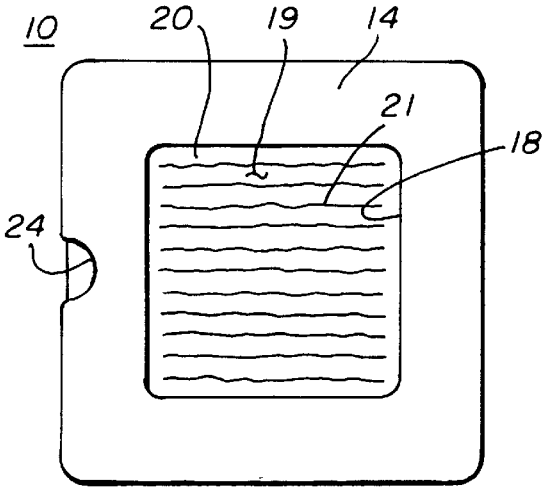
FIG. 2 is a rear view of the transparency display device of FIG. 1.
Figure 3:
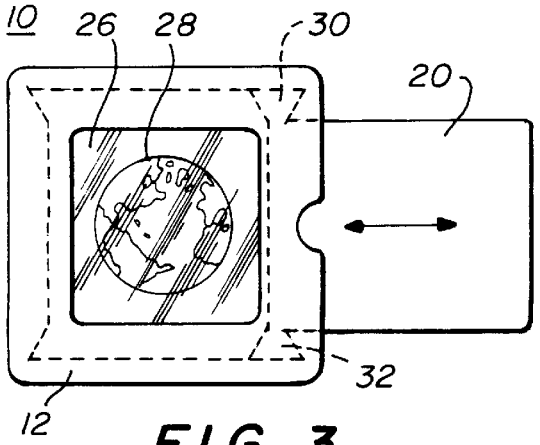
FIG. 3 is a front view of the transparency display device of FIG. 1 with a slidable panel moved outwardly from the front and back frames to expose only the transparency to view.

FIG. 1 is a front view of a first embodiment of the present invention. The transparency display device 10 of FIG. 1 includes front and back frames 12 and 14, shown respectively in FIG. 1 and FIG. 2, each having a window 16 and 18 therein in superimposed relationship with each other. A first transparency 26 has a first visual image 28 thereon and the transparency covers the windows 16 and 18 in the front and back frames. A first panel 20 having a front 23 and a back 19 (see FIG. 4) is slidably interposed between the front and back frames 12 and 14 for movement between a first position to enable viewing the transparency 26 and its visual image 28 with the front 23 of the first panel 20 serving as a backing for the transparency 26 to create a first scene and a second position shown in FIG. 3 to enable viewing the transparency visual image 28 alone as a second scene having a discernibly different visual effect than the first scene. Thus as can be seen in FIG. 1, when the panel 20 is in its first position under the transparency 26 and visual image 28, a first view is presented. When the panel 20 is slid outwardly from the front and back frames 12 and 14 as shown in FIG. 3, the visual image 28 on the transparency 26 is silhouetted between the two windows 16 and 18, therefore giving a discernibly different effect than the first scene. Appropriate indentations 22, 24, and 27 are formed in the front and back panels and the transparency to enable the slidable panel 20 to be gripped and moved outwardly from its first position to its second position as shown in FIG. 3.

Figure 4:
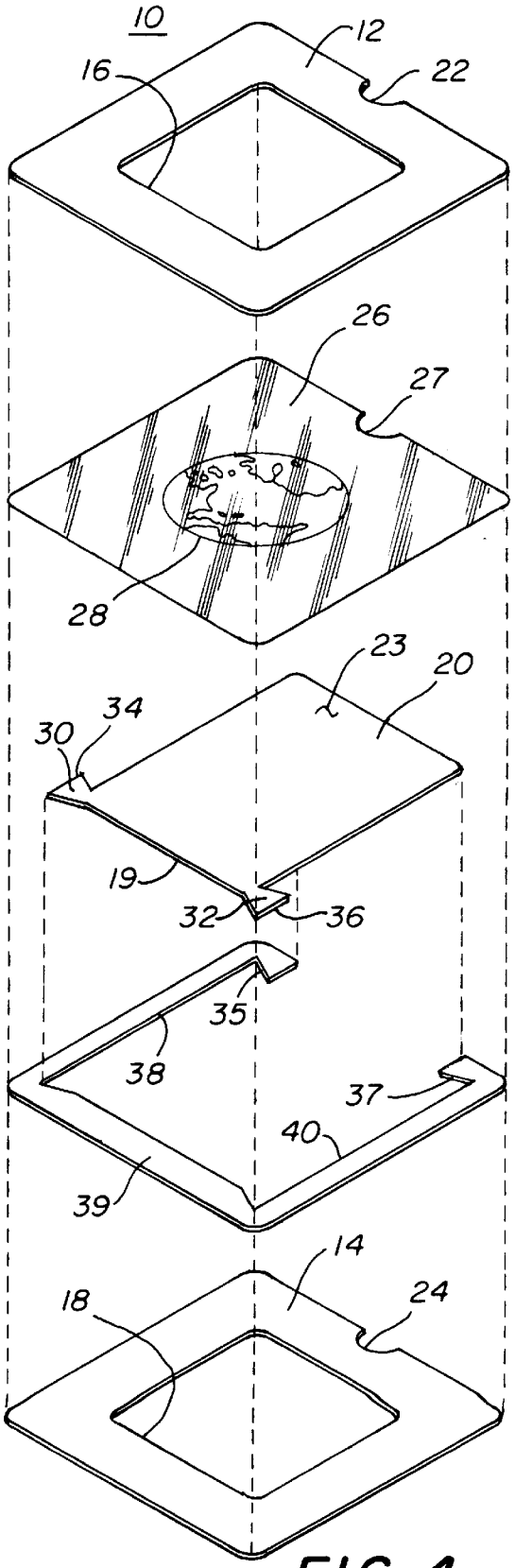
FIG. 4 is an exploded view of the transparency display device of FIG. 1.

The exploded view in FIG. 4 shows clearly the elements of the transparency display device of FIG. 1. It includes the front frame 12 with its associated window 16 and back frame 14 with its associated window 18. It illustrates the first transparency 26 having the visual image 28 thereon and the slidable panel 20 that slides in frame 39 as illustrated in FIG. 3. The slidable panel 20 has shoulders 30 and 32 thereon that are formed as truncated cones with the larger end of the cone facing outwardly to provide to provide large end surfaces 34 and 36 that ride against the sides 38 and 40 of the frame 39. When the panel 20 is slid outwardly, the shoulders 30 and 32 stop outward movement of panel 20 when they engage corresponding surfaces 35 and 37 on frame 39.

Thus, it can be seen that the novel embodiment of the transparency display device illustrated in FIGS. 1–4 has the front and back frames 12 and 14 each having a respective window 16 and 18 in superimposed relationship with each other and with transparency 26 having a visual image 28 thereon covering both of the windows. Slidable panel 20 is placed under the transparency 26 so that it can serve as a backing for the visual image 28 in a first position to present a first visual scene and then can be slid outwardly from the display device to a second position exposing simply the visual image 28 on the transparency 26 without a backing surface thus presenting a discernibly different second visual scene.

Figures 5A, 5B:
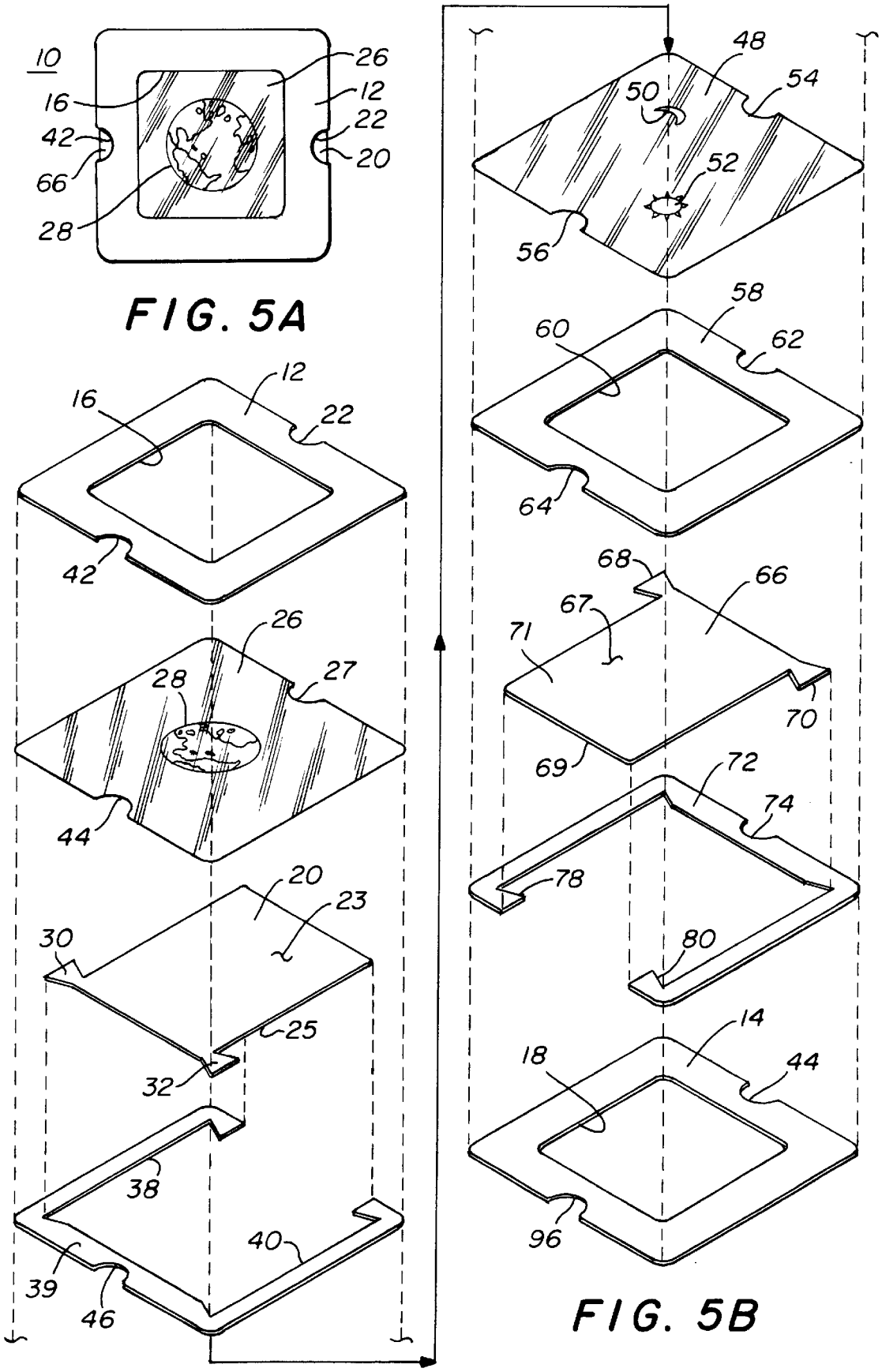
FIG. 5A is a front view of a second embodiment of the transparency display device.
FIG. 5B is an exploded view of the transparency display device of FIG. 5A illustrating two transparencies with visual images thereon and two slidable panels associated with the transparency display device.
Figure 7:
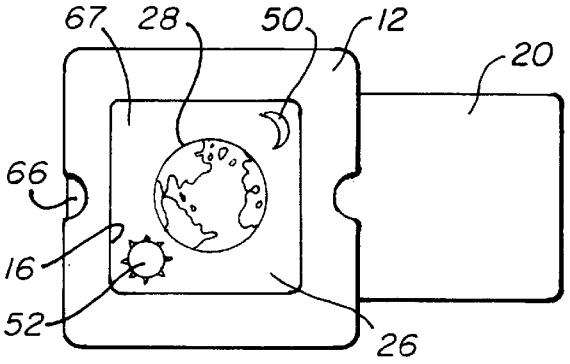
FIG. 7 is a front view of the transparency display device of FIG. 5A illustrating one of the slidable panels moved outwardly from the display device.

FIG. 5A is a front view of a second embodiment of a transparency display device of the present invention in which two slidable panels 20 and 66 are provided. As can be best seen in the exploded view in FIG. 5B, there are two transparencies, 26 and 48, each having respective visual images 28, 50, and 52 thereon. A first slidable panel 20 separates the two transparencies with their respective visual images. When the first slidable panel 20 is moved outwardly as illustrated in FIG. 7, the two visual images on both transparencies 26 and 48 are superimposed over each other. Thus, the representation of the earth 28 on the first transparency 26 is superimposed with the visual images of the moon 50 and the sun 52 on the second transparency 48. The second slidable panel 66 serves as a backing for the two transparencies.

Figure 8:
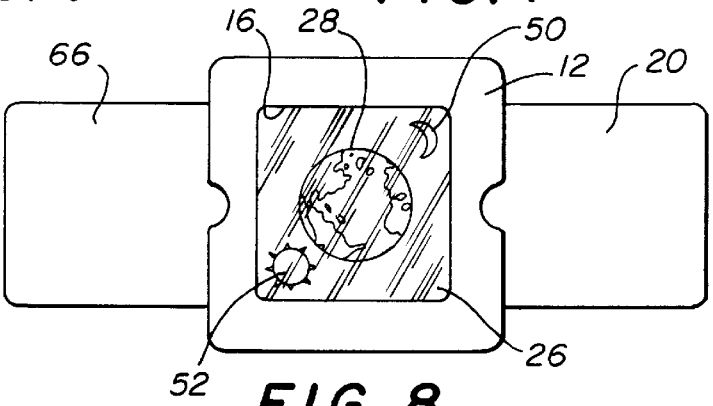
FIG. 8 is a front view of the display device of FIG. 5A illustrating both slidable panels extended outwardly from the display device.

However, as shown in FIG. 8, when both slidable panels 20 and 66 are moved outwardly, the two transparencies 20 and 48 are then in superimposed relationship only with each other to provide a distinctly different view than is shown in either FIG. 7 or FIG. 5A.

Figure 6:
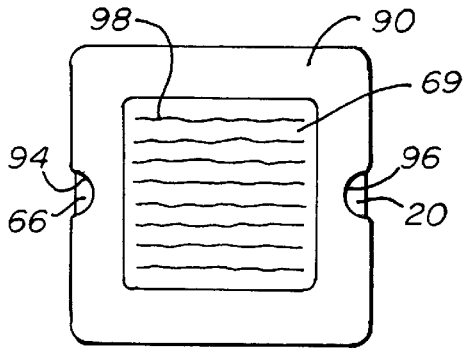
FIG. 6 is a rear view of the transparency display device of FIG. 5A.

FIG. 6 is a rear view of the transparency display device of FIG. 5A illustrating indicia 98 on the back 69 of the second slidable panel 66.

Figure 9:
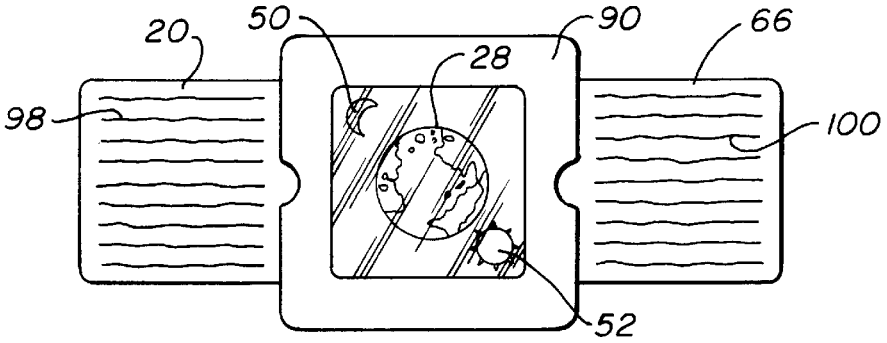
FIG. 9 is a rear view of the transparency display device of FIG. 8 illustrating indicia on the back side of each of the slidable panels.

FIG. 9 is a back view of the transparency display device of FIG. 8 illustrating indicia 98 and 100 on the back sides of both slidable panels 20 and 66. The indicia, of course, may relate to the visual images 28, 50, and 52 on the two transparencies.

It will be realized that, while the earth, moon, and stars are being shown in these views, the visual images could be famous people, sports figures, places such as the Grand Canyon, animals from the animal word, or plants and the like.

Figure 10:
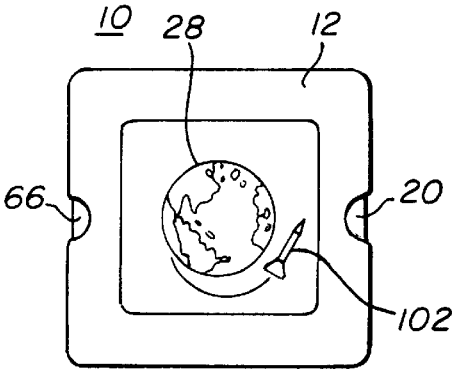
FIG. 10 is a front view of a third embodiment of the novel transparency display device.
Figure 11A:
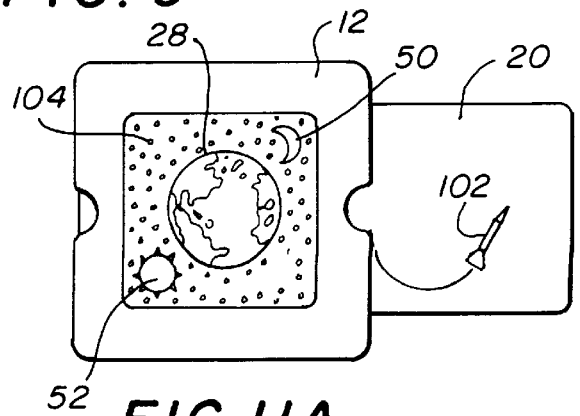
FIG. 11A is a front view of the novel transparency display device of FIG. 10 with one of the slidable panels moved outwardly from the display device.
Figure 11B:
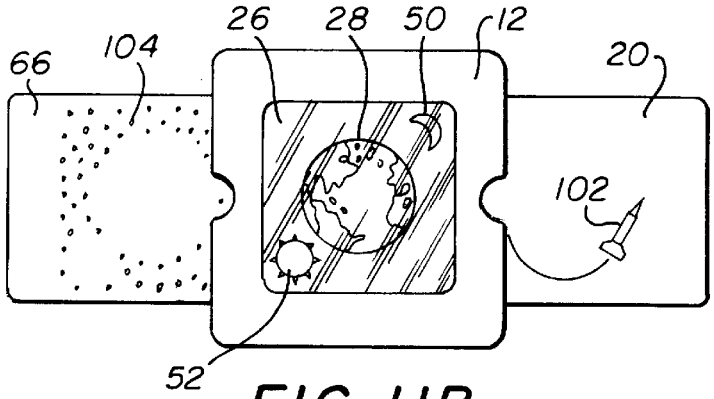
FIG. 11B is a front view of the novel transparency display device of FIG. 10 illustrating both slidable panels moved outwardly from the display device.

FIGS. 10, 11A, and 11B illustrate still a third embodiment of the novel transparency display device in which each of the first and second slidable panels have visual images thereon for combining with the visual image on a single transparency or two transparencies each having a visual image. Thus, in FIG. 10, the first transparency could be as transparency 26 in FIG. 5B and have the earth 28 thereon as the visual image while on the first slidable panel, such as panel 20 in FIG. 5B, is a visual image 102 such as a rocket. Thus when both panels are inwardly, the visual image 102 on slidable panel 20 is associated with the visual image 28 on the transparency. As shown in FIG. 11A, when the first slidable panel 20 is moved outwardly, a second different scene is produced by the addition of the moon 50 and the sun 52 as well as the stars 104. As shown in FIG. 11B, the stars 104 are on the second slidable panel 66 while the moon 50 and the sun 52 are on the second transparency 48 shown in FIG. 5B. Clearly, however, the moon 50 and the sun 52 could be combined with the stars 104 on the second slidable panel 66 so that only one transparency could be used as illustrated in FIG. 1. The preferred embodiment in this particular embodiment is to have a visual image on both the slidable panels 20 and 66 as well as to have two transparencies 26 and 48 such as shown in FIG. 5B.

Figure 12:
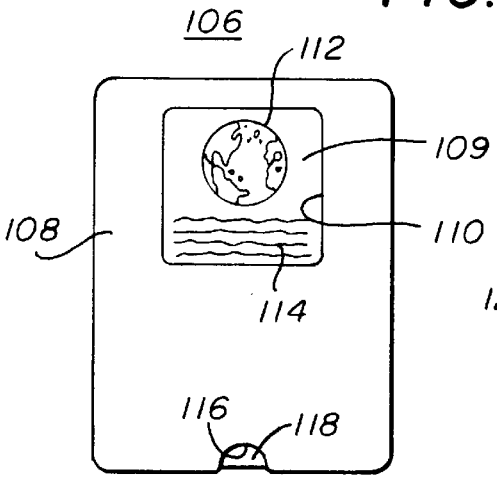
FIG. 12 is a front view of a fourth embodiment of the novel transparency display device of the present invention.
Figure 13:
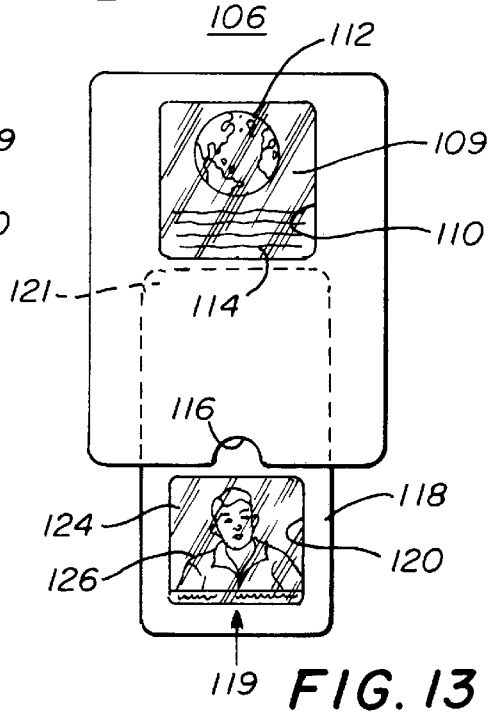
FIG. 13 is a front view of the transparency display device of FIG. 12 with the slidable panel removed outwardly to expose a second transparency in the movable panel.

FIG. 12 and FIG. 13 disclose still another embodiment of the present invention. In this case, the transparency 109 with its visual image 112 and any associated indicia 114 cover the windows in the front and back frames as in the embodiment illustrated in FIG. 3. However, the slidable panel 118, when moved outwardly from the display device 106 not only removes the backing from the transparency 109 to provide a scene having a discernibly different visual effect than shown in FIG. 12, but also discloses a second transparency 124 in the outer end of the slidable panel 118 having a second window 120 with a visual image 126 therein. The visual image 126 may relate if necessary to the visual image 109 in the display device. For instance, in FIG. 13, if the visual image 112 on the transparency 109 represents the earth, the visual image 126 in transparency 124 in the slidable panel 118 may be an astronaut associated with some flight from the earth that may be designated by the indicia 114 on transparency 109.

Figure 14:
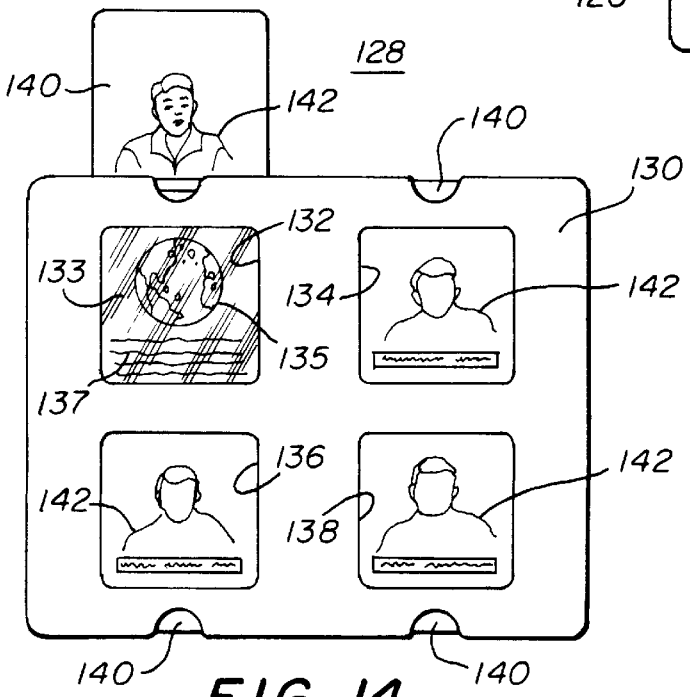
FIG. 14 illustrates a fifth version of the transparency display device of the present invention wherein multiple transparency displays are included in one frame, each of the transparency displays having associated with it a slidable panel that changes the scene that can be viewed.

FIG. 14 is still another embodiment of the present invention having front and back frames such as in FIG. 1 with the front frame 130 having therein at least two spaced-apart windows 132, 134, 136, and 138 in superimposed relationship with corresponding spaced windows in the back frame (not shown in FIG. 14). A transparency 133 covers all of the superimposed windows. Only one is shown in FIG. 14. Each of the transparencies shown in FIG. 14 has a visual image such as 135 thereon. Each of the windows has a corresponding slidable panel 140 associated therewith and interposed between each transparency and the front frame for individual movement between the first position exposing only the first visual image 142 on the transparency 133 and a second position exposing only the visual image on the panel. Thus as can be seen in FIG. 14, when one of the panels 140 is moved outwardly from the frame 130 as shown, the visual image 142 on panel 140 is displayed along with the transparency 133 having its visual image 135 and, if desired, indicia 137 thereon. However, when the panel 140 is in its first position over the transparency 133, then only the visual image 142 on the panel 140 is illustrated as in the windows 134, 136, and 138. Clearly, the panel 140 could be placed under the transparency 133 as shown in the preceding embodiments to add the visual image on the panel 140 to the visual image on the transparency 133.

Figure 15:
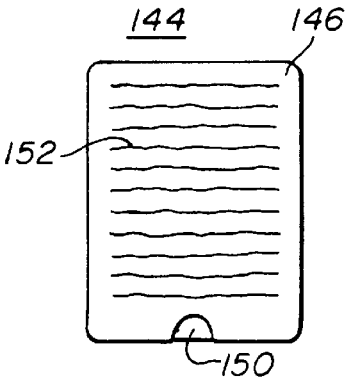
FIG. 15 is a front view of a sixth embodiment of the present transparency display device illustrating a transparency that is revealed when a slidable panel is moved outwardly from the transparency display device.
Figure 16:
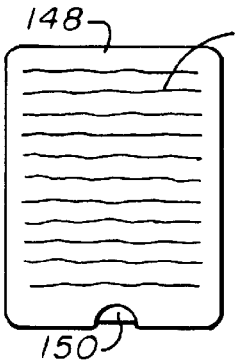
FIG. 16 is a rear view of the transparency display device of FIG. 15.
Figure 17:
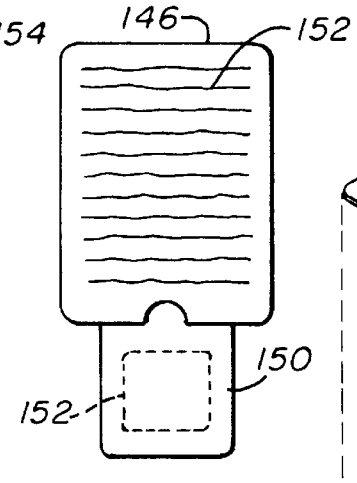
FIG. 17 is a front view of the transparency display device of FIG. 15 with the slidable panel moved outwardly from the device to expose a transparency having a visual image thereon.

FIGS. 15, 16, and 17 illustrate still another embodiment of the transparency display device. In this embodiment, the device 144 has a front side 146 with indicia 152 thereon and aback side 148 as illustrated in FIG. 16 with indicia 154 thereon. As shown in FIG. 17, when the movable panel 150 is moved outwardly from the display device, a window 152 is exposed which, again, may have a transparency and visual image thereon as illustrated in the preceding embodiment such as in FIG. 13. Thus the indicia 152 and 154 on the front and back side of the display device 144 may relate in detail to the visual image on the transparency in window 152.

Figure 18:
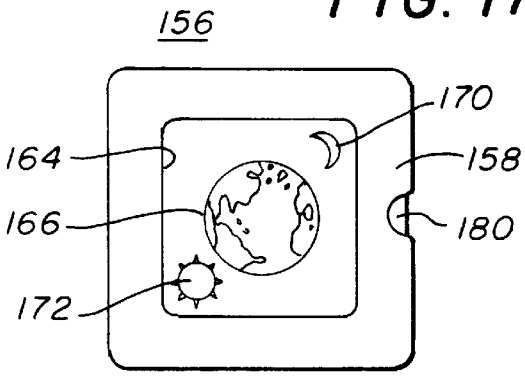
FIG. 18 is a front view of a seventh embodiment of the present invention having a transparency with a visual image thereon.
Figure 19:
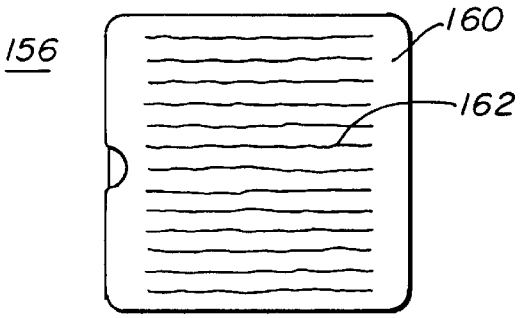
FIG. 19 is a rear view of the transparency display device of FIG. 18 illustrating information or indicia on the back of the display device that relates to the visual image that can be seen in the front view.
Figure 20:
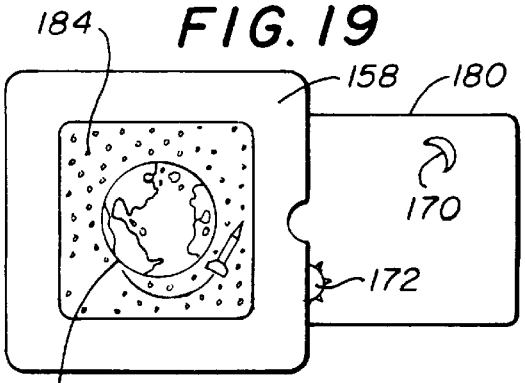
FIG. 20 is a front view of the transparency device of FIG. 18 illustrating the slidable panel moved outwardly from the display device with a visual image on the slidable panel and illustrating a visual image on the inside of the back panel that combines with the transparency visual image to form a second scene.
Figure 21:
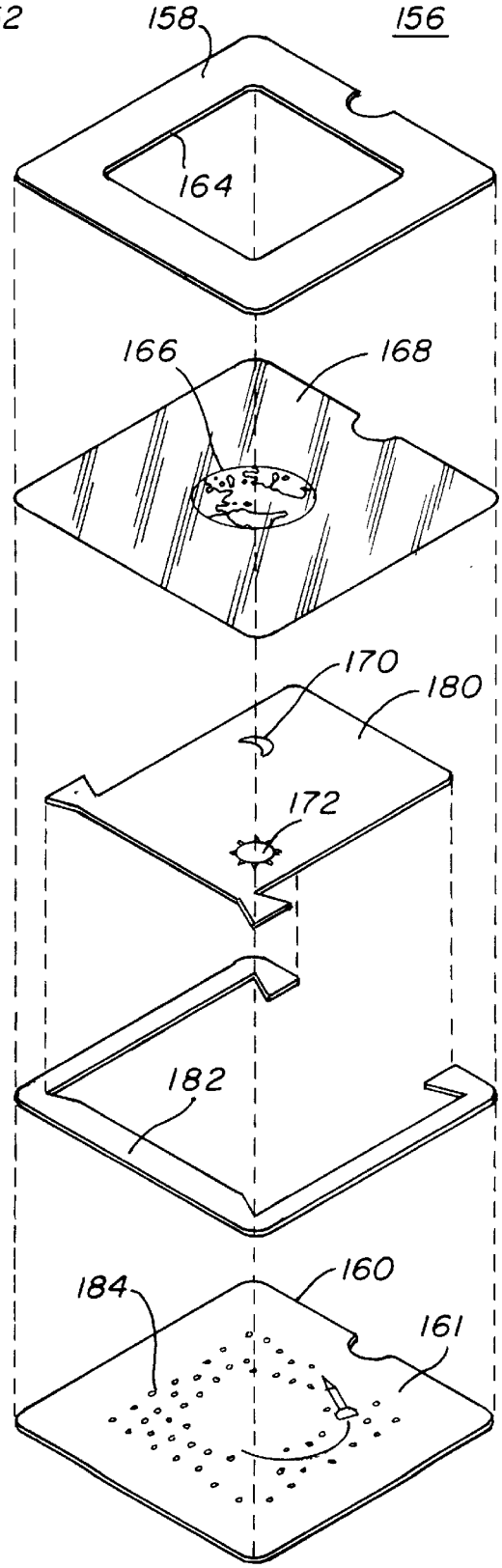
FIG. 21 is an exploded view of the transparency display device of FIG. 18.

FIGS. 18, 19, 20, and 21 illustrate still another embodiment of the present invention. FIG. 18 is a front view of a novel transparency display device 156 again having a window 164 with a transparency 168 (shown in FIG. 21) covering the window 164 and having a back panel 160, which does not have a window but instead has a visual image 184 thereon. The slidable panel 180 has a third visual image thereon including moon 170 and sun 172. As shown in FIG. 18, when the slidable panel 180 is in its first position under the transparency 168, the moon 170 and the sun 172 are superimposed with the visual image of the earth 166 on the transparency 168. However, as shown in FIG. 20, when the panel 180 is moved outwardly, then the visual image 184 on the inside of back panel 160 including the stars and rocket 184 are combined with the earth 166 to provide a different visual image.

Thus, there has been disclosed a novel visual display device in which different scenes may be formed by a viewer by having various combinations of transparencies with visual images thereon and slidable panels that may or may not have images thereon. By moving the slidable panels inwardly and outwardly from the display device, various scenes are formed that are attractive, unique, and unusual for the viewer's entertainment. These display devices may have visual images that relate to animals, vegetables, or minerals and include people, places, or things. Of significant importance are athletes and their achievements, other famous people and their lives, unique places such as the Grand Canyon, various memorials and the like and other information of importance. Clearly, such transparency devices could easily be formed into greeting cards by using the appropriate visual images and associated indicia.

The corresponding structures, materials, acts, and equivalents of all means or step plus function elements in the claims below are intended to include any structure, material, or act for performing the function in combination with other claimed elements as specifically claimed.

I claim:

1. A transparency display device comprising:

front and back frames each having a window in superimposed relationship with each other;

a first transparency having a first visual image thereon and covering said windows in said front and back frames; and a first slidable opaque panel slidably attached to said display device, said first slidable opaque panel having a front and a back and slidably interposed between said front and back frames for movement between a first position to enable viewing said first visual image with the first slidable opaque panel serving as a backing for said transparency to create a first scene and a second position to enable viewing said transparency as a second scene having a discernibly different visual effect than said first scene.

2. The transparency display device of claim 1 further including information on the back of said first slidable opaque panel related to said first visual image.

3. The transparency display device of claim 1 further comprising:

a middle frame having a window in superimposed relationship with both said windows in said front and back frames and interposed between said first slidable opaque panel and said back frame;

a second transparency having a second visual image thereon and covering said middle frame window;

said first slidable opaque panel covering said second transparency in its first position and forming said first scene and uncovering said second transparency in its second position to enable concurrent viewing of the first and second visual images of said first and second transparencies as said second scene; and a second slidable opaque panel slidably attached to said display device and interposed between said middle and back frames and having a first position serving as a backing for said second transparency to create a third scene formed of said first and second visual images and said second slidable opaque panel when said first slidable opaque panel is in its second position and a second position to enable a fourth scene of only said first and second visual images in said windows of said front, middle, and back frames.

4. A transparency display device comprising:

front, middle, and back frames, each having a window therein in superimposed relationship with each other;

a first transparency having a first visual image thereon and covering said front frame window;

a second transparency having a second visual image thereon and covering said middle frame window;

a first opaque panel having a front side and being slidably interposed between the first and second transparencies for movement between a first position serving as a backing for said first transparency and a second position exposing said second transparency in combination with said first transparency; and a second opaque panel having a back side and being slidably interposed between said middle and said back frames for movement, only when said first opaque panel is in its second position, between a first position for viewing said first and second transparencies with said second opaque panel serving as a backing for said first and second transparencies and a second position for viewing only said first and second transparencies in said windows of said front, middle, and back frames.

5. The transparency display device of claim 4 further including information on the back side of said second opaque panel that relates to at least one of said visual images.

6. A transparency display device comprising:

front, middle, and back frames, each having a window therein in superimposed relationship with each other;

a first transparency having a first visual image thereon and covering said front frame window;

a second transparency having a second visual image thereon and covering said middle frame window;

a first opaque panel having a front side and being slidably interposed between said front and middle frames for movement between first and second positions;

a third visual image on the front of said first opaque panel for forming a first combination view with said first transparency only when said first opaque panel is in its first position;

a second opaque panel having a back side and being slidably interposed between said middle frame and back frame for movement between first and second positions;

a fourth visual image on said second opaque panel for forming a second combination view of said first and second transparencies only when said first opaque panel is in its second position and said second opaque panel is in its first position; and a third combination view of only said first and second transparencies only when both said first and second panels are in their second positions.

7. The transparency display device of claim 6 further including information on the back side of said second opaque panel.

8. A transparency display device comprising:

front, middle, and back frames each having an opening therein in superimposed relationship with each other;

a transparency having a first visual image thereon and covering said window in said front frame;

a first opaque panel having front and back sides and being slidably interposed between said front and said middle frames for movement between first and second positions;

a second visual image on the front side of the first opaque panel that provides a combination view with said transparency only when said first opaque panel is in its first position;

a second opaque panel interposed between said middle and back frames for movement between first and second positions; and a third visual image on the front side of said second opaque panel that forms a combination view with said transparency only when the first opaque panel is in its second position and said second opaque panel is in its first position.

* * * * *